United States Patent [19]

Benoit

[11] 4,197,687

[45] Apr. 15, 1980

[54] INSULATED CLOSURE PANEL

[76] Inventor: Louis J. Benoit, 1893 Highland Pkwy., St. Paul, Minn. 55116

[21] Appl. No.: 4,094

[22] Filed: Jan. 17, 1979

[51] Int. Cl.[2] ..... E04C 1/00

[52] U.S. Cl. ..... 52/309.9; 52/262; 52/303

[58] Field of Search ..... 52/309.9, 94, 309.8, 52/309.4, 302, 303, 305, 91, 262, 319, 327, 92, 504, 95

[56] References Cited

U.S. PATENT DOCUMENTS

| | | | |
|---|---|---|---|
| 3,707,819 | 1/1973 | Calhoun et al. | 52/319 |
| 4,017,090 | 4/1977 | Cohen | 52/94 X |
| 4,125,971 | 11/1978 | Ward | 52/92 |
| 4,142,340 | 3/1979 | Howard | 52/262 |

*Primary Examiner*—James A. Leppink
*Assistant Examiner*—Carl D. Friedman
*Attorney, Agent, or Firm*—Wicks & Nemer

[57] ABSTRACT

An insulated closure panel is disclosed, in the preferred embodiment of the present invention, for closing off openings under floors and roof decks where prestressed double tee concrete construction spans are used. The closure panel includes an insulating core sandwiched between two facing members. The top and sides of the facing members are undersized from the top and sides of the core, thus allowing the closure panel to be inserted into the opening of the construction spans such that the core can be snuggly fit in the opening while avoiding chipping of the facing members or avoiding pulling the facing members away from the core. The closure panel can be held in the opening of the construction span by foam type construction adhesive. Further, caulking can be added in the groove formed between the top and side edges of the undersized facing member and the surface of the construction span for providing a seal therebetween. The facing members can be formed from various materials and have various finishes according to the construction job.

10 Claims, 6 Drawing Figures

INSULATED CLOSURE PANEL

BACKGROUND

The present invention relates generally to insulated closure panels and more specifically to insulated closure panels for closing off openings under floors and roof decks where prestressed double tee concrete construction spans are used.

In buildings constructed using prestressed double tee concrete construction spans, a need has arisen for members for closing off openings under floor and roof decks. Prior to the present invention, precast concrete was used and these concrete closures were dangerous and difficult to transport, install, and utilize. Also, wood or metal studs covered by suitable material were used. Since this arrangement was independently made for each opening, it was thus quite expensive and time consuming in making and installing. Therefore, a need has arisen for a closure which is inexpensive, lightweight, easy to install, custom fit, insulative, and provides a facing which can be easily finished.

SUMMARY

The present invention solves these and other problems in closures by providing, in the preferred embodiment, an insulated closure panel including a core and at least one facing member attached to the surface of the core. The top and sides of the facing member are undersized from the top and sides of the core allowing the closure panel to be inserted into openings such that the core can be snuggly fit in the opening while avoiding chipping of the facing member and avoiding pulling the facing member away from the core.

Thus, it is an object of the present invention to provide a novel insulated closure panel.

It is also an object of this invention to provide a novel insulated closure panel for closing off openings under floors and roof decks where prestressed double tee concrete construction spans are used.

It is also an object of this invention to provide a novel insulated closure panel including a core and a facing member.

It is also an object of this invention to provide a novel insulated closure panel which is lightweight and easily installed.

It is also an object of this invention to provide a novel insulated closure panel including a seat formed with the concrete span for receiving caulking.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
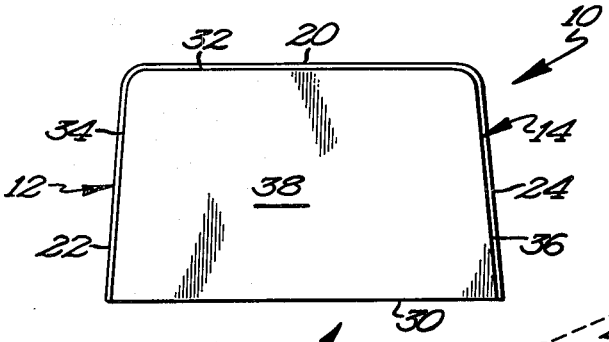
FIG. 1 shows a side elevational view of an insulated closure panel constructed according to the teachings of the present invention.
Figure 2:
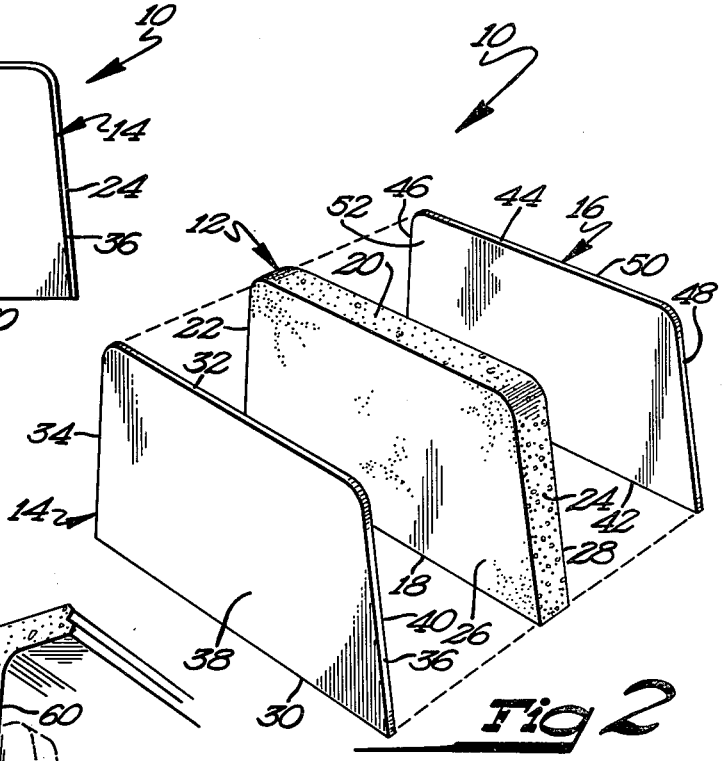
FIG. 2 shows an exploded perspective view of the panel of FIG. 1.

All figures are drawn for ease of explanation of the basic teachings of the present invention only; the extensions of the Figures with respect to number, position, relationship, and dimensions of the parts to form preferred embodiment will be explained or will be within the skill of the art after the following teachings of the present invention have been read and understood. Further, the exact dimensions and dimensional proportions to conform to specific force, weight, strength, insulation, and similar requirements will likewise be within the skill of the art after the following teachings of the present invention have been read and understood.

Where used in the various figures of the drawings, the same numerals designate the same or similar parts. Furthermore, when the terms, "top", "bottom", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

Figure 3:
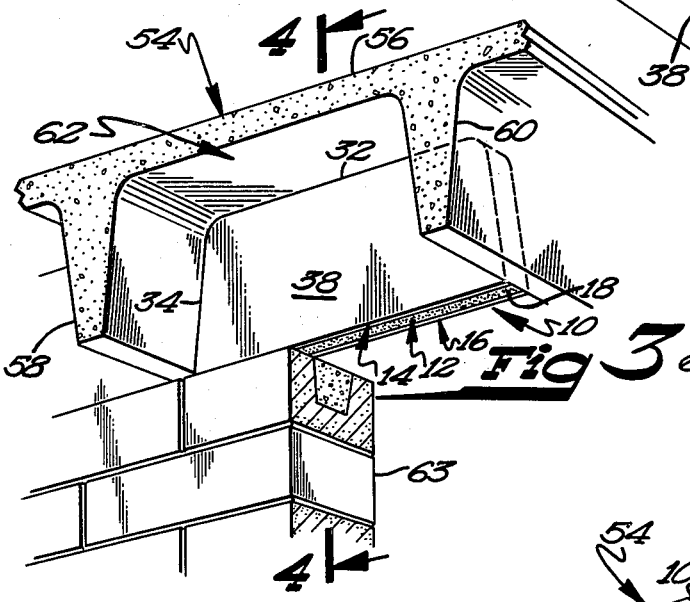
FIG. 3 shows the panel of FIG. 1 in place in an exemplary opening under the floor or roof deck of a prestressed double tee concrete construction span and utilized with a concrete block dividing wall.

In the figures, an insulated closure panel constructed according to the teachings of the present invention is shown for closing off openings under floor and roof decks where prestressed double tee concrete construction spans are used and is generally designated 10. Specifically, panel 10 is shown with a prestressed double tee concrete span 54 having a flat, plane member 56 and two, perpendicularly upstanding members 58 and 60. Thus, members 56, 58, and 60 have the shape of two "T" members from which it gets its name. In the preferred embodiment, panel 10 then closes openings 62 formed between members 58 and 60 and member 56 and the plane of the bottom ends of members 58 and 60. As is well known in the construction industry, spans 54 are placed on at least two support walls, which can be formed of concrete block as is wall 63 shown in FIGS. 3 and 4, such that the bottom ends of members 58 and 60 rest on the support wall 63. Further, dividing walls can be provided between the support walls, and can be made of suitable construction such as the stud and plaster wall 65 shown in FIG. 5 where the top header 67 abuts with the bottom ends of members 58 and 60.

Panel 10 then includes an insulation core 12, a first facing member 14, and a second facing member 16.

According to the preferred embodiment of the present invention, core 12 is made of suitable insulation material such as molded polystyrene, extruded polystyrene, urethane, or perlite for providing suitable insulating and sound transmission properties. Core 12 includes a bottom edge 18, a top edge 20, a first end edge 22, a second end edge 24, a first face 26, and a second face 28. Faces 26 and 28 are hot wire cut to the desired thickness in regard to the insulation qualities desired and to the desired partition thickness.

First facing member 14 includes a bottom edge 30, a top edge 32, a first end edge 34, a second end edge 36, an outside face 38, and an inside face 40. Similarly, second facing member 16 includes a bottom edge 42, a top edge 44, a first end edge 46, a second end edge 48, an outside face 50, and an inside face 52. According to the teachings of the present invention, the height of facing members 14 and 16 defined by the distance between top edges 32 and 44 and bottom edges 30 and 42, respectively, and is less than the height of core 12 defined by the distance between top edge 20 and bottom edge 18. Similarly, the width of facing members 14 and 16 defined by the distance between first edges 34 and 46 and second edges 36 and 48, respectively, and is less than the width of core 12 defined by the distance between first edge 22 and second edge 24.

Facing members 14 and 16 can be made of any desired thickness, such as ⅛, 3/16, or ¼ inch. Further, facing members 14 and 16 can be made of various suitable materials having the desired characteristics, such as of noncombustible material of suitable strengths. For example, facing members 14 and 16 can be made of gypsum board or cement asbestos. Boards sold under the tradenames "FLEXBOARD", "FLEXBOARD PRIMED", and "PERMATONE S" by Johns Manville or "GLASWELD" by Glasweld International have been found suitable for making facing members 14 and 16. It should then be noted that facing member 14 can be of a different material than facing member 16 so that different characteristics can be achieved. For example, one facing member can be made of decorative material while the other is made of flame retardant material such as facing member 14 can be made of gypsum board and facing member 16 can be made of cement asbestos.

Outside faces 38 and 50 of facing members 14 and 16 can have any desired finishes such as plain, primed, or painted, or can be factory finished, such as in colors to form an aesthetically pleasing closure.

Figure 6:
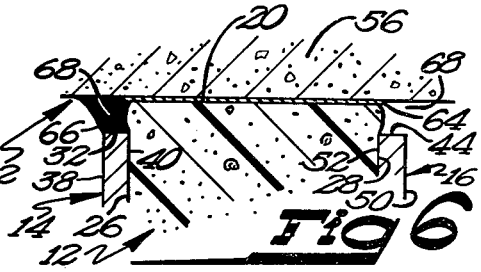
FIG. 6 shows an enlarged view of the junction between the panel of FIG. 1 and a prestressed double tee concrete construction span.
Figure 4:
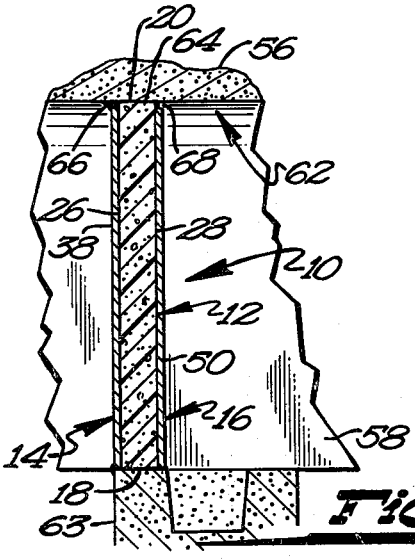
FIG. 4 shows a cross sectional view of the building of FIG. 3 including the panel of FIG. 1.

Inside faces 40 and 52 of facing members 14 and 16 are attached to faces 26 and 28 of core 12, respectively, such that core 12 is sandwiched between facing members 14 and 16. In the preferred embodiment, facing member 14 and 16 are attached to core 12 by a suitable laminate contact bond adhesive and in the preferred embodiment are 100% bonded. According to the teachings of the present invention, bottom edges 30 and 42 of facing members 14 and 16 are flush with bottom edge 18 of core 12 while edges 32, 44, 34, 46, 36, and 48 of facing members 14 and 16 are spaced from edges 20, 22, and 24 of core 12, respectively, as best seen in FIGS. 1, 4, and 6, for the reasons to be explained further hereinafter. The edges of facing member 14 and 16 can be undersized in the range of ⅛ to ½ inch, preferably ⅛ to ¼ inch and in the preferred embodiment are undersized ⅛ inch. It should then be noted that facing members 14 and 16 also prevent mechanical abuse to core 12, such as during transportation of panel 10.

Prior to the present invention, openings 62 of double tee construction spans 54 were, in one approach, closed by precast concrete of the size of openings 62. However, such concrete closures were heavy and thus were expensive in installing in that a hoist was needed to install the concrete closures, and the concrete closures required mechanical fasteners to hold them in place. Also, the concrete closures were expensive to transport. Further, such concrete closures were prone to breaking. Additionally, such concrete closures were dangerous due to their great weight if they fell out of openings 62 on people or property when they were being installed or after their installation and after completion of construction.

Also, prior to the present invention, openings 62 of the double tee construction spans 54 were closed, by another approach, by wood or metal studs and flat material attached thereto cut to size at the construction site to fit openings 62. However, this was expensive in materials and also labor due to the time consuming nature of individually fiting each opening 62 in spans 54.

The present invention solves these and other problems by providing a panel 10 which is light in weight, custom fit, and which is easy to install.

Now that the construction of panels 10 and the problems of prior closures have been set forth, further subtle features and advantages of the present invention can be set forth and explained in more detail.

After spans 54 have been positioned on the support walls and/or after all desired dividing walls have been made, a foam type construction adhesive 64 may be put on spans 54 and the top of the walls. Panel 12 is then placed in opening 62 such that adhesive 64 is along edges 18, 20, 22, and 24 of core 12 as best seen in FIG. 6. Further, the outside surface of panel 10 can be flush with the outside surface of the wall. Exterior panels which are exposed to wind load can then also include mechanical fastening on the interior side.

Due to the undersizing of the top and sides of facing members 14 and 16, caulking 66 can be added in the groove or seat 68 formed between the inside surface of spans 54 and edges 32, 34, and 36 and 44, 46, and 48 of facing members 14 and 16, as best seen in FIGS. 4 and 6. Caulking 66 provides a better seal between panel 10 and spans 54 for making the junction water and weather tight, helping in gluing panel 10 in place, and making panel 10 flush with span 54.

Thus, the undersizing of the top and sides of facing members 14 and 16 serves at least two purposes. First, the gap 68 between the edges 32, 34, and 36 and 44, 46, and 48 of facing members 14 and 16 and spans 54 acts as a seat for caulking as set forth above. Second, the undersizing avoids chipping facing members 14 and 16 and avoids delaminating facing members 14 and 16 from core 12 when panel 10 is placed in opening 62. Specifically, facing members 14 and 16 are undersized to fit the irregularities in spans 54 due to the tolerances allowed. If facing members 14 and 16 were not undersized, the facing members 14 and 16 could chip or delaminate from core 12.

It should be noted that edges 30 and 42 of facing members 14 and 16 are shown as flush with edge 18 of core 12 rather than undersized as are the top and sides of members 14 and 16. Thus, outside surfaces 38 and 50 of facing member 14 and 16 can be flush and continuous with the surfaces of the wall. Therefore, outside surfaces 38 and 50 can be finished with the surface of the wall, such as by plastering. Thus, outside surfaces 38 and 48 can be finished to match the outside surfaces of the wall upon which panel 10 is supported.

Figure 5:
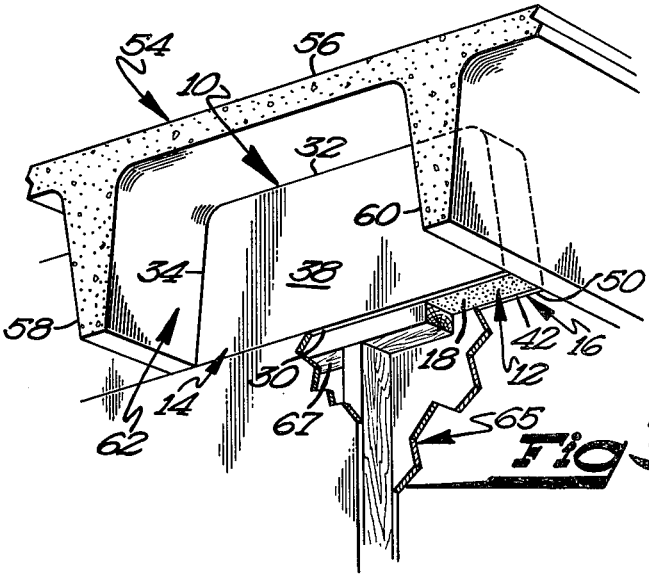
FIG. 5 shows the panel of FIG. 1 utilized with a dividing wall constructed of studs and plaster board.

Further, core 12 can be made of any desired thickness such as from ¾ inch to 5¾ inches according to the insulative "R" factor desired and the wall thickness. It should then be noted that panel 10 can have the same thickness as the wall upon which it rests such that outside surfaces 38 and 50 are flush and contiguous with both of the surfaces of the wall, as best seen in FIG. 5. However, if desired, panels 10 can be recessed from the surfaces of the wall.

It should then be further noted that the multilayer construction of panel 10 of the present invention has several advantages. First, facing members 14 and 16 can be undersized for the advantages stated above. Second, core 12 can be of a size allowing a snug fit in opening 62. Third, outside surfaces 38 and 50 can include any desired finish and can be made of any desired decorative material. Fourth, core 12 can be made of any desired thickness according to the wall thickness and the insulation "R" factor desired. Fifth, facing members 14 and 16 can be made of various materials, such as flame retardant, noncombustible materials to give the wall a desired fire rating. These and similar and further advantages are obtained by a multi-layer construction which cannot be achieved from a single sheet type construction.

It should then also be noted that panels 10 can be made at the factory thus greatly reducing manufacturing costs. Further, panels 10 can be custom fit for the particular job to fit the particular dimensions of the particular manufacturer of span 54. Panels 10 are light in weight and thus can be transported inexpensively and installed easily without costly labor and heavy hoisting equipment.

It should still further be noted that, due to the symmetrical shape of panel 10, panel 10 can be turned within opening 62 prior to its installation such that either facing member 14 or 16 can face outside the particular wall. Thus, "right" or "left" panels are not required.

Now that the basic teachings of the present invention have been explained, many extensions and variations will be obvious to one having ordinary skill in the art. For example, although first and second facing members 14 and 16 are shown in the preferred embodiment of the present invention, one facing member need only be used.

Thus, since the invention disclosed herein may be embodied in other specific forms without departing from the spirit or the general characteristics thereof, some of which forms have been indicated, the embodiment described herein is to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. An insulated closure panel for closing off openings where prestressed double tee concrete construction spans are used, comprising, in combination: a core having a bottom edge, a top edge, a first side edge, a second side edge, a first face, and a second face; at least one facing member having a bottom edge, a top edge, a first side edge, a second side edge, an outside face, and an inside face; with the inside surface of the facing member being attached to one of the surfaces of the core; and with the height of the facing member defined by the distance between the top edge and the bottom edge of the facing member being less than the height of the core defined by the distance between the top edge and the bottom edge of the core and with the width of the facing member defined by the distance between the first edge and the second edge of the facing member being less than the width of the core defined by the distance defined by the first edge and the second edge of the core such that at least the top edge and side edges of the facing member are undersized from the top edge and the side edges of the core allowing the closure panel to be inserted into the opening of the construction spans such that the core can be snuggly fit in the opening while avoiding chipping of the facing member and avoiding pulling of the facing member away from the core.

2. The insulated closure panel of claim 1 wherein a groove is formed between at least the top edge and the side edges of the facing member and the construction span due to the undersizing of the facing member, which groove forms a seat for receiving caulk therein for providing a better seal between the insulated closure panel and the construction span.

3. The insulated closure panel of claim 2 further comprising a second facing member wherein the first facing member is attached to the first side of the core and the second facing member is attached to the second side of the core such that the core is sandwiched between the first and second facing members and protects the core from mechanical abuse.

4. The insulated closure panel of claim 1 further comprising a second facing member wherein the first facing member is attached to the first side of the core and the second facing member is attached to the second side of the core such that the core is sandwiched between the first and second facing members and protects the core from mechanical abuse.

5. The insulated closure panel of claim 1 wherein the closure panel is held in place by a foam type construction adhesive placed upon the construction span before insertion of the insulated closure panel and does not require the use of mechanical fasteners.

6. The insulated closure panel of claim 1 wherein the bottom edge of the facing member is flush with the bottom edge of the core and wherein the outside surface of the facing member maybe flush with the surface of the wall such that the outside surface of the facing member can be finished to match the surrounding surfaces of the wall.

7. The insulated closure panel of claim 1, 2, or 4 wherein at least the top and side edges of the facing member are undersized of the top and side edges of the core by an amount in the range of $\frac{1}{8}$ to $\frac{1}{4}$ of an inch.

8. The insulated closure panel of claim 1, 2, or 4 wherein the facing member is formed of flame retardant, noncombustible material to provide a fire rating to the closure panel.

9. The insulated closure panel of claim 1, 2, or 4 wherein the facing member is made of decorative material to form an aesthetically pleasing closure.

10. The insulated closure panel of claim 1 wherein the core is made of insulating material and can be of a desired thickness according to the insulation "R" factor desired and the wall thickness.

* * * * *